US006698870B2

(12) United States Patent
Gunther

(10) Patent No.: US 6,698,870 B2
(45) Date of Patent: Mar. 2, 2004

(54) BALL CHECK VALVE FOR BULK INK SUPPLY SYSTEM

(75) Inventor: Max S Gunther, La Jolla, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/206,554

(22) Filed: Jul. 25, 2002

(65) Prior Publication Data

US 2004/0017444 A1 Jan. 29, 2004

(51) Int. Cl.[7] ..... B41J 2/175
(52) U.S. Cl. ..... 347/85
(58) Field of Search ..... 347/85, 84, 19, 347/23, 86, 87, 7, 65, 6, 2; 205/122; 137/454.2; 417/536

(56) References Cited

U.S. PATENT DOCUMENTS

| | | | | |
|---|---|---|---|---|
| 4,339,761 A | | 7/1982 | Matsumoto et al. | |
| 5,367,328 A | * | 11/1994 | Erickson | 347/7 |
| 6,164,766 A | | 12/2000 | Erickson | |
| 6,172,694 B1 | | 1/2001 | Droege et al. | 347/85 |
| 6,283,585 B1 | * | 9/2001 | Ikkatai et al. | 347/85 |
| 6,364,472 B1 | | 4/2002 | Hmelar et al. | |
| 2001/0022603 A1 | | 9/2001 | Eida | |
| 2002/0024570 A1 | | 2/2002 | Childers et al. | |
| 2002/0145650 A1 | | 10/2002 | Pan et al. | |

FOREIGN PATENT DOCUMENTS

| | | |
|---|---|---|
| JP | 57-103876 | 6/1982 |
| WO | WO 95/07412 | 3/1995 |

OTHER PUBLICATIONS

EP Search Report dated Nov. 6, 2003, 3 pages.

* cited by examiner

*Primary Examiner*—Raquel Yvette Gordon
*Assistant Examiner*—Charles Stewart, Jr.

(57) ABSTRACT

A ball check valve for use in a bulk ink supply system of an inkjet printing system, for disposal in an ink flow path between an ink reservoir and a printhead, so as to control back pressure at the printhead thereby reducing the occurrence of de-priming of the printhead, including a valve body defining a chamber with an inlet and an outlet; a ball disposed in the chamber, the ball having a diameter; a ball retainer disposed in the inlet, the ball retainer having an aperture with a diameter which is less than the diameter of the ball, wherein backflow of ink in the chamber causes the ball to seat against the ball retainer, placing the ball check valve in a closed position such that ink flow through the aperture is restricted.

21 Claims, 3 Drawing Sheets

BALL CHECK VALVE FOR BULK INK SUPPLY SYSTEM

FIELD OF THE INVENTION

The present invention relates generally to the field of inkjet printing, and more particularly, to bulk ink supplies for inkjet printing systems.

BACKGROUND

In many conventional bulk ink supply systems for inkjet printers, the printhead of the inkjet printer is supplied with ink from an ink reservoir remote from the printhead by means of ink tubes or lines. Bulk ink supply systems are characteristically sold in industrial markets, typically for address printing. One such exemplary system is the Hp c6119a bulk ink supply system, which includes an ink reservoir with a snap cap (interconnector) which routes an ink tube to a printhead. The ink reservoir/snap cap/ink tube assembly is sold intact and containing ink, the free end of the ink tube being sealed by a fluid interconnect device. During initial setup of the Hp c6119a, the user connects the ink reservoir/snap cap/ink tube assembly to the printhead by inserting the fluid interconnect into a septum/clip device on the printhead. Once this permanent connection is made, the negative pressure, or back pressure at the printhead nozzles is then primarily determined by the positioning of the ink reservoir in relation to the printhead, not by the spring bag in the printhead.

The fact that the back pressure at the printhead nozzle is primarily determined by the positioning of the ink reservoir can lead to a failure mode. Specifically, if the printhead (nozzle plate) is positioned more than about 25 cm above the reservoir then a de-prime occurs, as the back pressure at the nozzles exceeds about 25 cm $H_2O$. De-priming means that air is pulled into the nozzles and into the headland/standpipe of the printhead. Air in this region can lead to printhead failures (ranging from a few nozzles out to all nozzles out). De-prime failures caused by excessive back pressure at the nozzle can occur during initial setup, cleaning of the printhead, or any time the end user handles the bulk ink supply system. De-prime failure is the primary reason cited by users for returning bulk ink supply systems for refund/exchange.

Competing with the need to limit excessive back pressure at the printhead for proper printing operation, is the need to maintain sufficient back pressure to prevent unintended discharge of ink from the nozzles of a printhead (ink drool). Specifically, as the back pressure at the printhead approaches 0 cm $H_2O$, the capillary forces drawing the ink overcome the back pressure force and ink drool occurs. Ink drool is a common problem in bulk ink supply systems, but does not cause functional failures. Ink drool caused by insufficient back pressure at the nozzle can occur during initial setup, cleaning of the printhead, or any time the end user handles the bulk ink supply system, where the positioning level of the printhead approaches that of the reservoir. Thus, when properly controlled, back pressure substantially prevents ink drool from a printhead and acts to draw ink from an ink supply.

One prior art attempt to address printhead de-prime problems can be found in U.S. Pat. No. 6,172,694 (Droege et al.), which utilizes a flapper-type gate valve.

Thus, a need exists for a check valve for use in a bulk ink supply system, which better controls the back pressure at the printhead and thereby reduces the occurrence of de-priming of the printhead.

SUMMARY OF THE INVENTION

The present invention is directed to a ball check valve for use in a bulk ink supply system of an inkjet printing system, for disposal in an ink flow path between an ink reservoir and a printhead, so as to control back pressure at the printhead thereby reducing the occurrence of de-priming of the printhead, comprising: a valve body defining a chamber with an inlet and an outlet; a ball disposed in the chamber, the ball having a diameter; a ball retainer disposed in the inlet, the ball retainer having an aperture with a diameter which is less than the diameter of the ball, wherein backflow of ink in the chamber causes the ball to seat against the ball retainer, placing the ball check valve in a closed position such that ink flow through the aperture is restricted.

According to another embodiment of the present invention, a bulk ink supply system for supplying ink to an inkjet printer comprises: an ink reservoir; a printhead in fluid communication with the ink reservoir; an ink flow path between the ink reservoir and the printhead; and a ball check valve disposed in the ink flow path, wherein the ball check valve is adapted to control back pressure at the printhead thereby reducing the occurrence of de-priming of the printhead.

A further embodiment of the present invention is a method of controlling back pressure at a printhead in a bulk ink supply system thereby reducing the occurrence of de-priming of a printhead, comprising the steps of: disposing a ball check valve in an ink flow path between the printhead and an ink reservoir; and placing the ball check valve in a closed position when backflow of ink in the ball check valve occurs.

A yet further embodiment of the present invention is a method of making a ball check valve adapted to control back pressure in a bulk ink supply system, thereby reducing the occurrence of de-priming of a printhead, the bulk ink supply system having an ink reservoir, a printhead in fluid communication with the ink reservoir via an ink flow path, and an interconnector disposed in the ink flow path between the printhead and the ink reservoir, comprising the steps of: disposing a ball within the interconnector; and disposing a ball retainer within the interconnector, wherein the ball retainer has an aperture and a valve seat for sealably engaging the ball such that backflow of ink in the ball check valve causes the ball to seat against the valve seat, placing the ball check valve in a closed position such that ink flow through the aperture is restricted.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF THE EMBODIMENTS

Reference will now be made in detail to exemplary embodiments of the invention. Wherever possible, the same reference numbers will be used throughout the drawings to refer to the same or like parts.

Throughout the following description, the term "back pressure" is used to generally describe a negative pressure lower than ambient atmospheric pressure in a portion of an ink delivery device/system (e.g., within a plenum, an ink chamber, a printhead, an ink conduit, etc.) as described, for example, in U.S. Pat. No. 5,886,718. In addition, the term "backflow" is used to indicate ink flow throughout an entire a bulk ink supply system, or in any specified portion thereof, in a direction of an ink reservoir. These terms are not intended to be limiting on the disclosure, but are used to better illustrate features of the present invention, as they would be readily understood to one of ordinary skill in the art.

Figure 1:
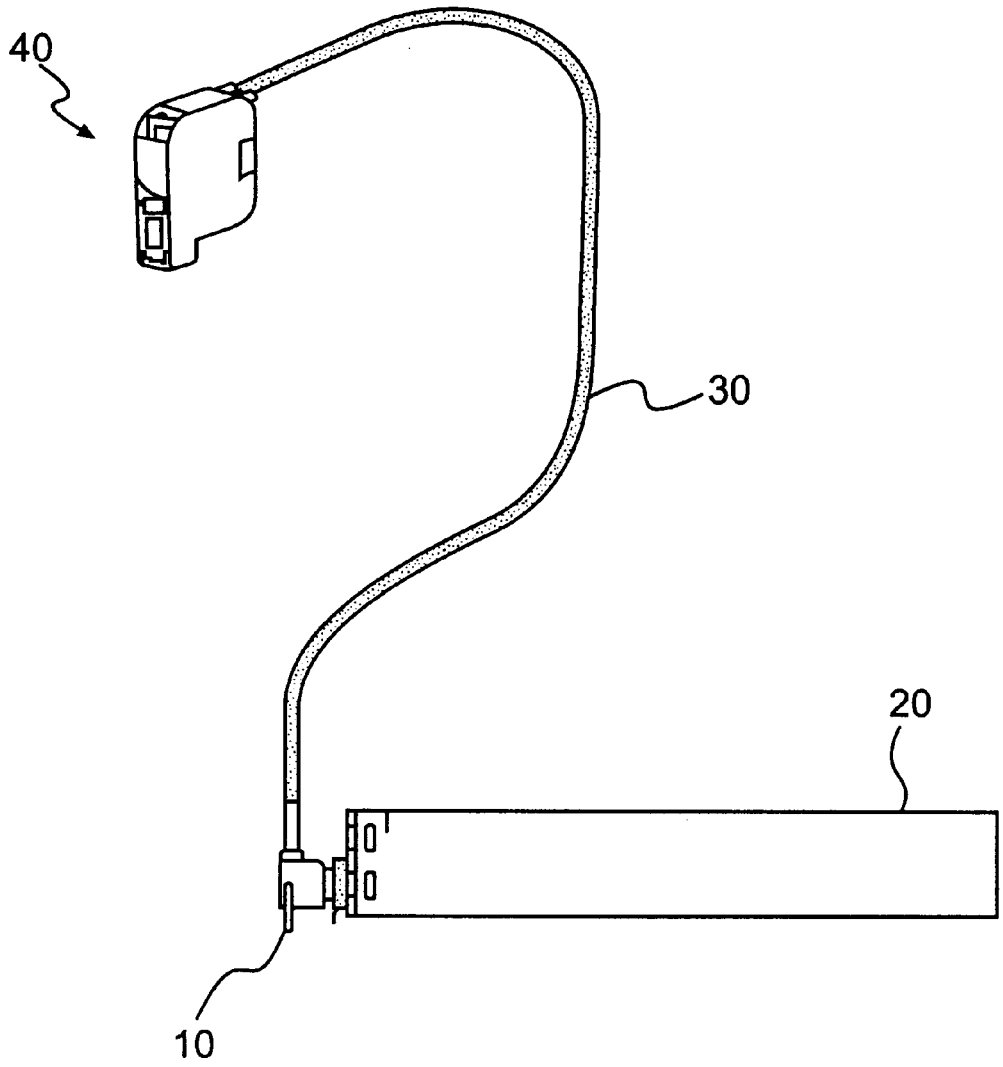
FIG. 1 is a schematic view of an exemplary bulk ink supply system according to an embodiment of the present invention.

FIG. 1 shows a first embodiment of a bulk ink supply system for supplying ink to an inkjet printer (not shown) in an inkjet printing system according to the present invention. The bulk ink supply system comprises an ink reservoir 20, a printhead 40 in fluid communication with the ink reservoir 20, an ink flow path, comprising in one embodiment an interconnector 10 and a conduit 30, between the ink reservoir 20 and the printhead 40, and a ball check valve (shown in FIG. 2) disposed in the ink flow path, wherein the ball check valve is adapted to control back pressure at the printhead thereby reducing the occurrence of de-priming of the printhead.

The conduit 30 is shown in FIG. 1 with a single delivery flow/return ink flow path. However, other ink conduit configurations are also possible, such as a single conduit with separate delivery flow and return flow paths, multiple delivery flow paths and multiple return flow paths. In addition, one or more other components (not shown) may be provided between the ink reservoir 20 and the printhead 40 for performing various other functions.

Figure 2:
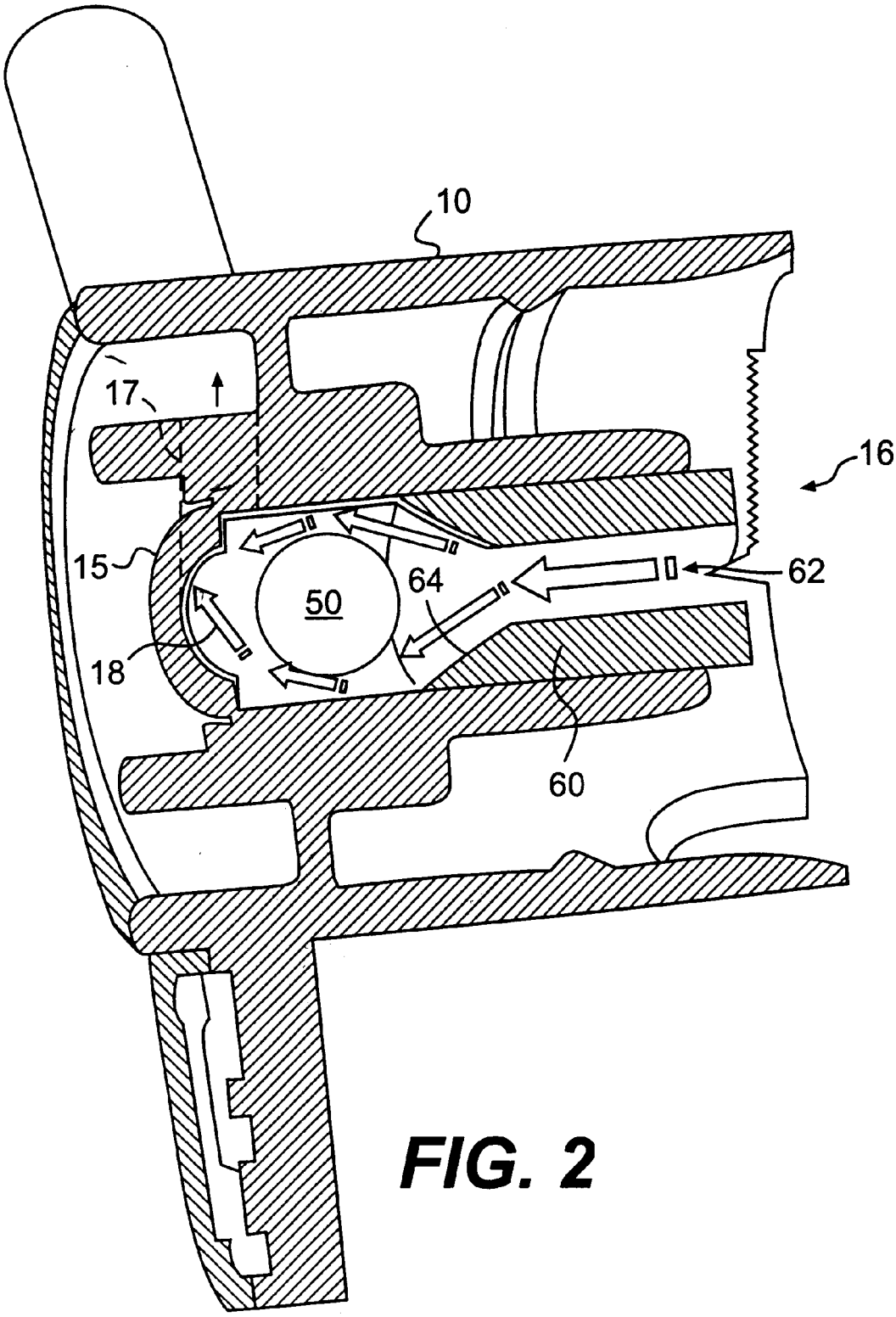
FIG. 2 is a cross sectional side view of an interconnector having a ball check valve, indicating ink flow in the direction of the printhead according to an embodiment of the present invention.

Referring to FIG. 2, one embodiment of the ball check valve is shown comprising a valve body 15 defining a chamber 18 with an inlet 16 and an outlet 17, and a ball 50 disposed in the chamber 18, the ball 50 having a diameter. The embodiment further comprises a ball retainer 60 disposed in the inlet 16, the ball retainer 60 having an aperture 62 with a diameter which is less than the diameter of the ball 50. Backflow of ink in the chamber 18 causes the ball 50 to seat against the ball retainer 60, placing the ball check valve in a closed position such that ink flow through the aperture is restricted. The outlet 17 has any convenient geometry that will prevent the ball 50 from passing out of the chamber 18 through the outlet 17, or from seating against the outlet or otherwise restricting ink flow into the outlet 17. In one embodiment the ball retainer 60 may be a separate element that is inserted into the inlet 16.

Figure 3B:
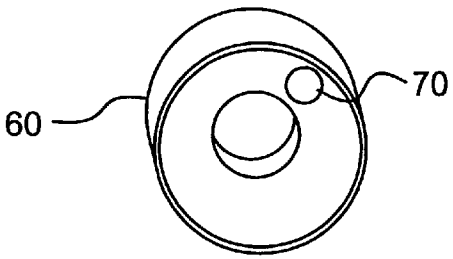
FIG. 3B is an end perspective view of a ball retainer with an aperture and having an orifice according to an embodiment of the present invention.
Figure 3A:
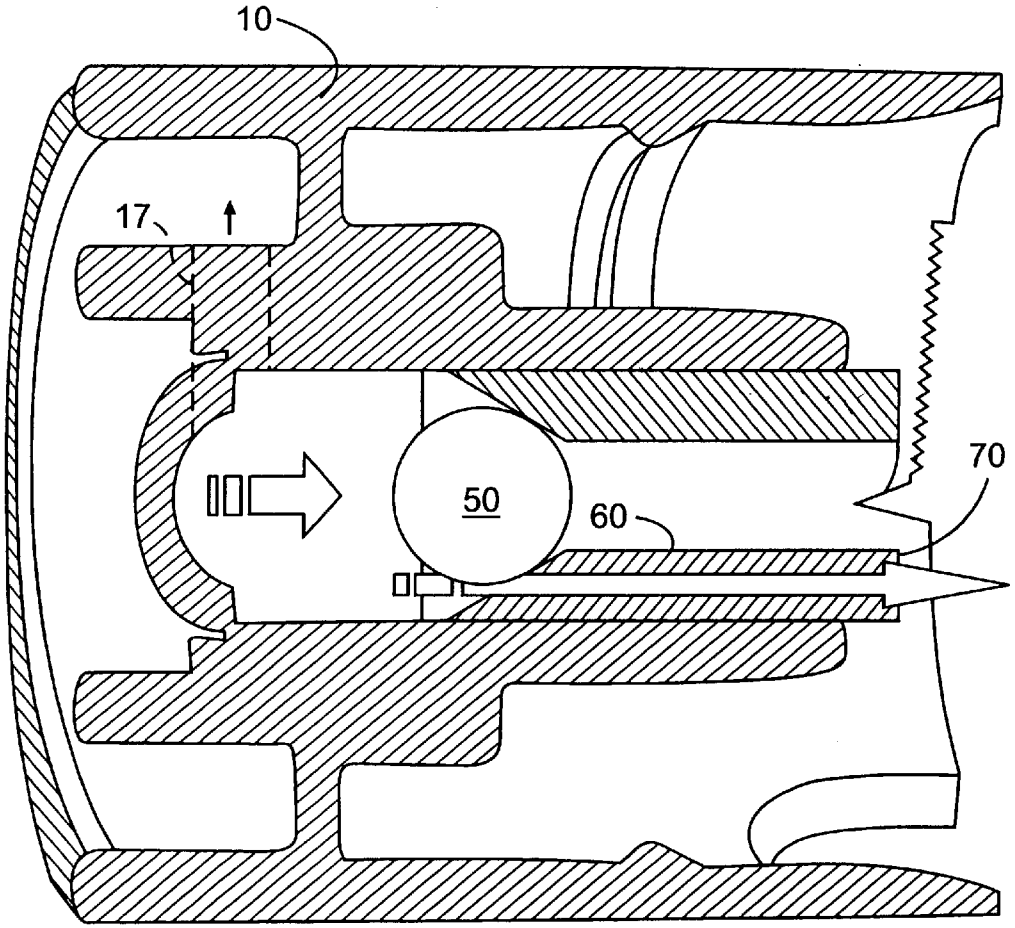
FIG. 3A is a view similar to FIG. 2 indicating ink flow in the direction of the ink reservoir according to an embodiment of the present invention.

The ball retainer 60 may include at least one orifice 70 that extends from a first end of the ball retainer 60 to a second end of the ball retainer 60, as shown in FIG. 3B. Thus, the closed ball check valve may be deliberately bypassed such that ink flows through the at least one orifice 70 into the ink reservoir 20, as shown in FIG. 3A. The result is that the backflow of ink is not altogether prevented. This bypass acts to substantially prevent ink drool from the nozzles of a printhead as described above. The orifice 70 may have a diameter, for example, which is about $1/10^{th}$ of the diameter of the aperture.

A valve seat 64 on the ball retainer 60 may include a tapering constriction, i.e., an inner diameter of the aperture of the ball retainer 60 grows progressively smaller, in the direction of the ink reservoir 20, as shown in FIG. 2. This tapering design increases the seating surface of the ball retainer 60.

In one embodiment of the present invention, the ball 50 is about the same density as the ink. The ball 50 may be comprised, for example, of a high density polypropelyene material. Such material is compatible with most conventional inks, tending to inhibit degradation of the ball 50 from its contact with the ink. The ball 50 may be about the same density as the ink such that the ball 50 flows with the ink and is neutrally buoyant (neither sinks nor floats). Neutral buoyancy may be achieved by forming the ball out of a material having a density approximately the same as ink, such as, for example, high density polypropelene. This design has the effect that the ball 50 will seat against the valve seat as described above, under any orientation of the ball check valve.

During printing operations ink flows through the aperture 62 in the ball retainer 60 into the chamber 18 of the ball check valve in the direction of the printhead 40. When ink is flowing in this direction, the ball 50 moves freely about the chamber 18, unrestrained by the ball retainer 60 and not seated in the valve seat 64, so that the ball check valve is in an open position. Very little pressure is required to unseat the ball 50 from the ball retainer 60. Impurities found in the ink are less likely to accumulate on the seating surfaces of the ball 50 and the ball retainer 60 than with conventional gate valves for at least the following reasons. This is because the ball 50 moves freely about when the ball check valve is open so that ink flows through a wide-open aperture. Thus, the ball check valve is less likely to act as a filter than a gate valve. Additionally, because the ball 50 is rotating and its orientation is changing when the ball check valve is open, the seating surface of the ball 50 changes as well. This rotation tends to reduce the amount of accumulation of impurities on any particular seating surface portion of the ball 50. Third, impurities are less likely to adhere to the rounded seating surface of the ball 50 than the relatively flat seating surface of a gate.

When ink flows in the ball check valve in the direction of the ink reservoir 20, the ball 50 seats in the valve seat 64 so that the ball check valve is in a closed position. Seating of the ball 50 in this manner does not create back pressure in the bulk ink supply system. When the ball check valve is closed, ink flow into the aperture of the ball retainer 60 is restricted, whereby backflow of ink is limited and thus backpressure at the printhead 40 is controlled, which tends to prevent de-prime of the printhead 40.

According to another embodiment of the present invention, a method of making a ball check valve is provided that includes disposing a ball 50 and a ball retainer 60 within an interconnector 10 disposed in a fluid ink flow path between an ink reservoir 20 and a printhead 40. One embodiment of the method contemplates inserting the ball 50 into the chamber 18 and press fitting the ball retainer 60 into the inlet of the interconnector 10. This particular method of making the ball check valve can be accomplished without the need to modify, for example, the interconnector 10 currently provided in the Hp c6119a bulk ink supply system which is described above. That is, the ball retainer 60 can be sized such that it fits securely into the existing inlet of the interconnector 10 of the Hpc6119a bulk ink supply system. Alternatively, the ball retainer 60 may be integrally formed within the interconnector 10. It may be possible to also dispose the ball check valve in other commercially available bulk ink supply systems according to the methods disclosed herein.

Hence, the present disclosure provides for an improved inkjet printing system, and more particularly, to an improved bulk ink supply system for inkjet printing systems. The present invention may have one or more of the following advantages, it minimizes interruptions in ink flow by requiring very little pressure to open; is less susceptible to improper seating due to the accumulation of foreign matter on the seating surfaces; is made of material that is compatible with the ink and thus is not itself a source of impurities; does not cause, or impede recovery from ink drool; and it does not create enough back pressure itself upon closing so as to promote printhead de-priming.

It should be noted that although the description provided herein recites a specific order of method steps, it is understood that the order of these steps may differ from what is described and/or depicted. Also two or more steps may be performed concurrently or with partial concurrence. Such variation will depend on the systems chosen, and more generally on designer choice. It is understood that all such variations are within the scope of the invention.

The foregoing description of various embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined the claims appended hereto, and their equivalents.

What is claimed is:

1. A ball check valve for use in a bulk ink supply system of an inkjet printing system, for disposal in an ink flow path between an ink reservoir and a printhead, so as to control back pressure at the printhead thereby reducing the occurrence of de-priming of the printhead, comprising:

a valve body defining a chamber with an inlet and an outlet;

a ball disposed in the chamber, the ball having a diameter;

a ball retainer disposed in the inlet, the ball retainer having an aperture with a diameter which is less than the diameter of the ball, wherein backflow of ink in the chamber causes the ball to seat against the ball retainer, placing the ball check valve in a closed position such that ink flow through the aperture is restricted.

2. The ball check value of claim 1, wherein the ball retainer is a separable element that is inserted into the inlet.

3. The ball check valve of claim 1, further comprising at least one orifice in the ball retainer, wherein the ink is allowed to bypass the closed ball check valve.

4. The ball check valve of claim 1, wherein a seating surface of ball retainer has a tapering constriction in the direction of the ink reservoir.

5. The ball check valve of claim 1, wherein the ball is about the same density as the ink.

6. A bulk ink supply system for supplying ink to an inkjet printer, comprising:

an ink reservoir;

a printhead in fluid communication with the ink reservoir;

an ink flow path between the ink reservoir and the printhead; and a ball check valve disposed in the ink flow path, wherein the ball check valve is adapted to control back pressure at the printhead thereby reducing the occurrence of de-priming of the printhead.

7. The bulk ink supply system of claim 6, wherein the ball check valve includes:

a valve body defining a chamber with an inlet and an outlet;

a ball disposed in the chamber, the ball having a diameter; and a ball retainer disposed in the inlet, the ball retainer having an aperture with a diameter which is less than the diameter of the ball, wherein backflow of ink in the chamber causes the ball to seat against the ball retainer, placing the ball check valve in a closed position such that ink flow through the aperture is restricted.

8. The bulk ink supply system of claim 7, further comprising at least one orifice in the ball retainer, wherein the ink is allowed to bypass the closed ball check valve.

9. The bulk ink supply system of claim 7, wherein a valve seat in the ball retainer has a tapering constriction in the direction of the ink reservoir.

10. The bulk ink supply system of claim 7, wherein the ball is about the same density as the ink.

11. A method of controlling back pressure at a printhead in a bulk ink supply system thereby reducing the occurrence of de-priming of a printhead, comprising the steps of:

disposing a ball check valve in an ink flow path between the printhead and an ink reservoir; and placing the ball check valve in a closed position when backflow of ink in the ball check valve occurs.

12. The method of claim 11 wherein the ball check valve includes:

a valve body defining a chamber with an inlet and an outlet;

a ball disposed in the chamber, the ball having a diameter;

a ball retainer disposed in the inlet, the ball retainer having an aperture with a diameter which is less than the diameter of the ball, wherein backflow of ink in the chamber causes the ball to seat against the ball retainer, placing the ball check valve in a closed position such that ink flow through the aperture is restricted.

13. The method of claim 12, further comprising the step of providing an orifice in the ball check valve wherein ink can bypass the closed ball check valve and flow through the orifice in the direction of the ink reservoir.

14. The method of claim 12, wherein the ball retainer has a valve seat which has a tapering constriction in the direction of the ink reservoir.

15. The method of claim 12, wherein the ball is about the same density as the ink.

16. A method of making a ball check valve adapted to control back pressure in a bulk ink supply system, thereby reducing the occurrence of de-priming of a printhead, the bulk ink supply system having an ink reservoir, a printhead in fluid communication with the ink reservoir via an ink flowpath, and an interconnector disposed in the ink flow path between the printhead and the ink reservoir, comprising the steps of:

disposing a ball within the interconnector; and disposing a ball retainer within the interconnector, wherein the ball retainer has an aperture and a valve seat for sealably engaging the ball such that backflow of ink in the ball check valve causes the ball to seat against the valve seat, placing the ball check valve in a closed position such that ink flow through the aperture is restricted.

17. The method of claim 16, wherein the ball retainer is disposed by press fitting the ball retainer within the interconnector.

18. The method of claim 16, wherein the ball retainer is integrally formed within the interconnector.

19. The method of claim 16, further comprising the step of providing an orifice in the ball check valve wherein ink can bypass the closed ball check valve and flow through the bypass orifice in the direction of the ink reservoir.

20. The method of claim 16, wherein the ball check valve has a valve seat which has a tapering constriction in the direction of the ink reservoir.

21. The method of claim 16, wherein the ball has about the same density as the ink.

* * * * *